US009506367B2

(12) United States Patent
Clouse

(10) Patent No.: US 9,506,367 B2
(45) Date of Patent: Nov. 29, 2016

(54) BLADE OUTER AIR SEAL HAVING INWARD POINTING EXTENSION

(75) Inventor: Brian Ellis Clouse, Saugus, MA (US)

(73) Assignee: UNITED TECHNOLOGIES CORPORATION, Farmington, CT (US)

( * ) Notice: Subject to any disclaimer, the term of this patent is extended or adjusted under 35 U.S.C. 154(b) by 927 days.

(21) Appl. No.: 13/554,273

(22) Filed: Jul. 20, 2012

(65) Prior Publication Data

US 2014/0140825 A1 May 22, 2014

(51) Int. Cl.
*F01D 11/08* (2006.01)
*F01D 25/24* (2006.01)

(52) U.S. Cl.
CPC ..... *F01D 11/08* (2013.01); *F01D 25/246* (2013.01); *F05D 2240/11* (2013.01); *Y10T 29/49297* (2015.01)

(58) Field of Classification Search
CPC ..... F01D 11/08; F01D 5/225; F01D 11/12; F01D 11/127; F01D 25/246
See application file for complete search history.

(56) References Cited

U.S. PATENT DOCUMENTS

| | | | | |
|---|---|---|---|---|
| 4,425,078 | A * | 1/1984 | Robbins | F01D 11/005 277/628 |
| 4,825,365 | A * | 4/1989 | Inoue | 382/131 |
| 5,044,881 | A | 9/1991 | Dodd et al. | |
| 5,131,813 | A * | 7/1992 | Przytulski | F01D 5/03 416/217 |
| 5,145,316 | A | 9/1992 | Birch | |
| 5,192,185 | A * | 3/1993 | Leonard | 415/170.1 |
| 5,662,457 | A * | 9/1997 | Bechtel et al. | 415/135 |
| 5,791,871 | A | 8/1998 | Sech et al. | |
| 6,120,242 | A * | 9/2000 | Bonnoitt et al. | 415/9 |
| 6,966,752 | B2 * | 11/2005 | Gieg et al. | 415/173.4 |
| 7,144,220 | B2 | 12/2006 | Marcin, Jr. | |
| 7,553,128 | B2 | 6/2009 | Abdel-Messeh et al. | |
| 7,721,433 | B2 | 5/2010 | Thompson et al. | |
| 7,988,410 | B1 | 8/2011 | Liang | |
| 8,061,979 | B1 | 11/2011 | Liang | |
| 8,118,547 | B1 | 2/2012 | Liang | |
| 2004/0090013 | A1 | 5/2004 | Lawer et al. | |
| 2005/0004810 | A1 | 1/2005 | Tanaka | |
| 2008/0211192 | A1 | 9/2008 | Pietraszkiewicz et al. | |
| 2009/0214329 | A1 | 8/2009 | Joe et al. | |
| 2011/0171011 | A1 | 7/2011 | Lutjen et al. | |

FOREIGN PATENT DOCUMENTS

| | | |
|---|---|---|
| EP | 2469043 A2 | 6/2012 |
| GB | 2249356 | 5/1992 |
| WO | 2005003520 A1 | 1/2005 |

OTHER PUBLICATIONS

International Preliminary Report on Patentability for International Application No. PCT/US2013/050228 dated Oct. 8, 2013.
International Search Report and Written Opinion for International Application No. PCT/US2013/050228 dated Oct. 8, 2013.
Extended European Search Report for European Application No. 13820433.4, mailed Mar. 7, 2016.

* cited by examiner

*Primary Examiner* — Igor Kershteyn
(74) *Attorney, Agent, or Firm* — Carlson, Gaskey & Olds

(57) ABSTRACT

A blade outer air seal (BOAS) for a gas turbine engine according to an exemplary aspect of the present disclosure includes, among other things, a seal body having a radially inner face and a radially outer face that axially extend between a leading edge portion and a trailing edge portion and a seal land that extends from the seal body and includes an inward pointing extension that extends radially inwardly from the radially inner face.

22 Claims, 3 Drawing Sheets

BLADE OUTER AIR SEAL HAVING INWARD POINTING EXTENSION

BACKGROUND

This disclosure relates to a gas turbine engine, and more particularly to a blade outer air seal (BOAS) that may be incorporated into a gas turbine engine.

Gas turbine engines typically include a compressor section, a combustor section and a turbine section. During operation, air is pressurized in the compressor section and is mixed with fuel and burned in the combustor section to generate hot combustion gases. The hot combustion gases are communicated through the turbine section, which extracts energy from the hot combustion gases to power the compressor section and other gas turbine engine loads.

Both the compressor and turbine sections may include alternating series of rotating blades and stationary vanes that extend into the core flow path of the gas turbine engine. For example, in the turbine section, turbine blades rotate and extract energy from the hot combustion gases that are communicated along the core flow path of the gas turbine engine. The turbine vanes, which generally do not rotate, guide the airflow and prepare it for the next set of blades.

A casing of an engine static structure may include one or more blade outer air seals (BOAS) that provide an outer radial flow path boundary of the core flow path. The BOAS are positioned in relative close proximity to a blade tip of each rotating blade in order to seal between the blades and the casing.

SUMMARY

A blade outer air seal (BOAS) for a gas turbine engine according to an exemplary aspect of the present disclosure includes, among other things, a seal body having a radially inner face and a radially outer face that axially extend between a leading edge portion and a trailing edge portion. A seal land extends from the seal body and includes an inward pointing extension that extends radially inwardly from the radially inner face.

In a further non-limiting embodiment of the foregoing BOAS, a retention flange extends from the seal body.

In a further non-limiting embodiment of either of the foregoing BOAS, the retention flange may include a radially outer portion and a radially inner portion, and the radially outer portion is received within a slot of a casing of the gas turbine engine and a vane segment rests against the radially inner portion.

In a further non-limiting embodiment of any of the foregoing BOAS, the retention flange is positioned radially outwardly from the seal land.

In a further non-limiting embodiment of any of the foregoing BOAS, the retention flange contacts at least one support portion of the seal land.

In a further non-limiting embodiment of any of the foregoing BOAS, the at least one support portion is an axially extending portion of the seal land.

In a further non-limiting embodiment of any of the foregoing BOAS, a seal is attached to the radially inner face of the seal body.

In a further non-limiting embodiment of any of the foregoing BOAS, the seal is a honeycomb seal.

In a further non-limiting embodiment of any of the foregoing BOAS, a seal may extend between the inward pointing extension and a vane segment.

In a further non-limiting embodiment of any of the foregoing BOAS, a radially innermost surface of the inward pointing extension extends inboard from a blade tip of a blade that rotates relative to the seal body.

A gas turbine engine according to another exemplary aspect of the present disclosure including, among other things, a compressor section, a combustor section in fluid communication with said compressor section, a turbine section in fluid communication with said combustor section, and a blade outer air seal (BOAS) associated with at least one of said compressor section and said turbine section. The BOAS includes a seal body having a radially inner face and a radially outer face that axially extend between a leading edge portion and a trailing edge portion. A seal land extends from the seal body and includes an inward pointing extension. A retention flange retains the BOAS relative to a casing of the gas turbine engine.

In a further non-limiting embodiment of the foregoing gas turbine engine, a radially innermost surface of the inward pointing extension extends inboard from a blade tip of a blade of one of the compressor section and the turbine section.

In a further non-limiting embodiment of either of the foregoing gas turbine engines, the retention flange includes a radially outer portion and a radially inner portion, and the radially outer portion is received within a slot of the casing and a vane segment of one of the compressor section and the turbine section rests against the radially inner portion.

In a further non-limiting embodiment of any of the foregoing gas turbine engines, a seal extends within a pocket between the inward pointing extension and a vane segment.

In a further non-limiting embodiment of any of the foregoing gas turbine engines, at least a portion of the retention flange extends radially outwardly from the seal.

A method of incorporating a blade outer air seal (BOAS) for use in a gas turbine engine, according to an exemplary aspect of the present disclosure includes, among other things, positioning a seal between a vane segment of the gas turbine engine and a seal land of the BOAS and supporting a retention flange of the BOAS with the seal land to radially support the vane segment.

In a further non-limiting embodiment of the foregoing method of incorporating a BOAS, the method may include blocking hot combustion gases from escaping a core flow path of the gas turbine engine with the seal land.

In a further non-limiting embodiment of either of the foregoing methods of incorporating a BOAS, the method may include the step of blocking which includes shielding the vane segment with an inward pointing extension of the seal land.

In a further non-limiting embodiment of any of the foregoing method of incorporating a BOAS, the method may include the step of supporting which includes positioning at least one support portion of the seal land radially inwardly from the retention flange.

In a further non-limiting embodiment of any of the foregoing method of incorporating a BOAS, the method may include a radially outer portion of the retention flange received within a slot of a casing that surrounds the BOAS and the vane segment rests against a radially inner portion of the retention flange.

The various features and advantages of this disclosure will become apparent to those skilled in the art from the following detailed description. The drawings that accompany the detailed description can be briefly described as follows.

DETAILED DESCRIPTION

Figure 1:
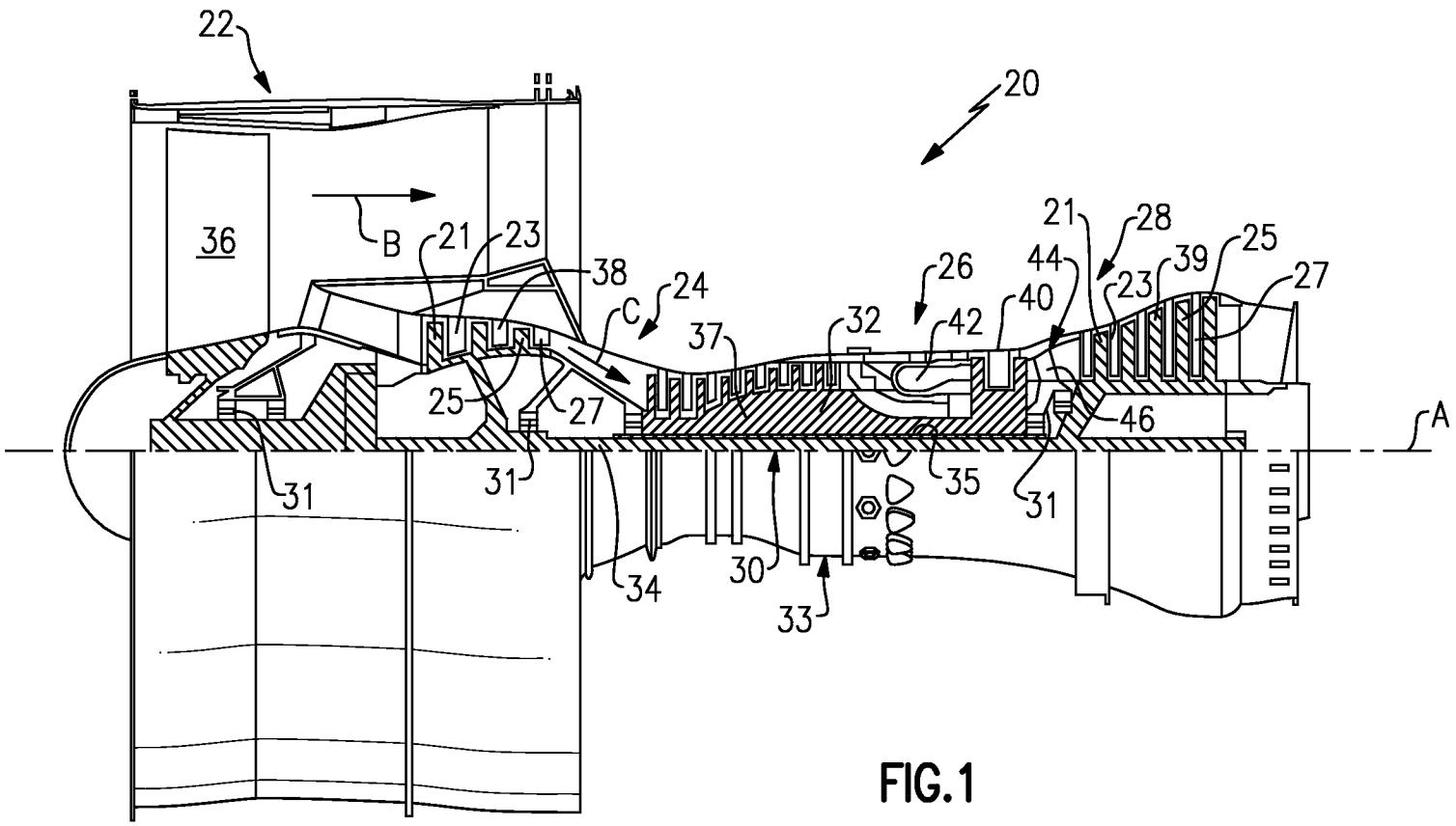
FIG. 1 illustrates a schematic, cross-sectional view of a gas turbine engine.

FIG. 1 schematically illustrates a gas turbine engine 20. The exemplary gas turbine engine 20 is a two-spool turbofan engine that generally incorporates a fan section 22, a compressor section 24, a combustor section 26 and a turbine section 28. Alternative engines might include an augmenter section (not shown) among other systems for features. The fan section 22 drives air along a bypass flow path B, while the compressor section 24 drives air along a core flow path C for compression and communication into the combustor section 26. The hot combustion gases generated in the combustor section 26 are expanded through the turbine section 28. Although depicted as a turbofan gas turbine engine in the disclosed non-limiting embodiment, it should be understood that the concepts described herein are not limited to turbofan engines and these teachings could extend to other types of engines, including but not limited to, turboshaft engines.

The gas turbine engine 20 generally includes a low speed spool 30 and a high speed spool 32 mounted for rotation about an engine centerline longitudinal axis A. The low speed spool 30 and the high speed spool 32 may be mounted relative to an engine static structure 33 via several bearing systems 31. It should be understood that additional bearing systems 31 may alternatively or additionally be provided.

The low speed spool 30 generally includes an inner shaft 34 that interconnects a fan 36, a low pressure compressor 38 and a low pressure turbine 39. The high speed spool 32 includes an outer shaft 35 that interconnects a high pressure compressor 37 and a high pressure turbine 40. In this embodiment, the inner shaft 34 and the outer shaft 35 are supported at various axial locations by bearing systems 31 positioned within the engine static structure 33.

A combustor 42 is arranged between the high pressure compressor 37 and the high pressure turbine 40. A mid-turbine frame 44 may be arranged generally between the high pressure turbine 40 and the low pressure turbine 39. The mid-turbine frame 44 supports one or more bearing systems 31 of the turbine section 28. The mid-turbine frame 44 may include one or more airfoils 46 that may be positioned within the core flow path C.

The inner shaft 34 and the outer shaft 35 are concentric and rotate via the bearing systems 31 about the engine centerline longitudinal axis A, which is co-linear with their longitudinal axes. The core airflow is compressed by the low pressure compressor 38 and the high pressure compressor 37, is mixed with fuel and burned in the combustor 42, and is then expanded over the high pressure turbine 40 and the low pressure turbine 39. The high pressure turbine 40 and the low pressure turbine 39 rotationally drive the respective high speed spool 32 and the low speed spool 30 in response to the expansion.

Each of the compressor section 24 and the turbine section 28 may include alternating rows of rotor assemblies and vane assemblies (shown schematically) that carry airfoils that extend into the core flow path C. For example, the rotor assemblies can carry a plurality of rotating blades 25, while each vane assembly can carry a plurality of vanes 27 that extend into the core flow path C. The blades 25 of the rotor assemblies create or extract energy (in the form of pressure) from core airflow that is communicated through the gas turbine engine 20. The vanes 27 of the vane assemblies direct core airflow to the blades 25 of the rotor assemblies to either add or extract energy. As is discussed in greater detail below, blade outer air seals (BOAS) can be positioned in relative close proximity to the blade tip of each blade in order to seal between the blades and the engine static structure 33.

Figure 2:
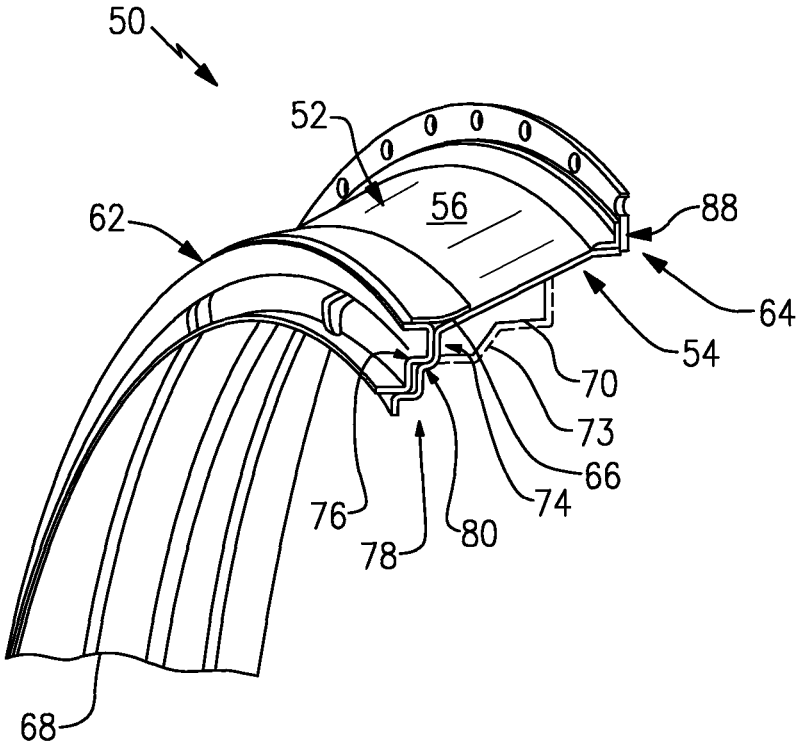
FIG. 2 illustrates a blade outer air seal (BOAS) that can be incorporated into a gas turbine engine.

FIG. 2 illustrates one exemplary embodiment of a BOAS 50 that may be incorporated into a gas turbine engine, such as the gas turbine engine 20. The BOAS 50 of this exemplary embodiment is a segmented BOAS that can be positioned and assembled relative to a multitude of additional BOAS segments to form a full ring hoop assembly that circumscribe the rotating blades 25 of either the compressor section 24 or the turbine section 28 of the gas turbine engine 20. The BOAS 50 can be circumferentially disposed about the engine centerline axis A (See FIG. 3). It should be understood that the BOAS 50 could embody other designs and configurations within the scope of this disclosure.

The BOAS 50 includes a seal body 52 having a radially inner face 54 and a radially outer face 56. The seal body 52 axially extends between a leading edge portion 62 and a trailing edge portion 64, and circumferentially extends between a first mate face 66 and a second mate face 68. The BOAS 50 may be constructed from any suitable sheet metal. Other materials, including but not limited to high temperature metallic alloys, are also contemplated as within the scope of this disclosure.

A seal 70 can be secured to the radially inner face 54 of the seal body 52. The seal 70 may be brazed or welded to the radially inner face 54, or could be attached using other techniques. In one exemplary embodiment, the seal 70 is a honeycomb seal that interacts with a blade tip 58 of a blade 25 (see FIG. 3) to reduce airflow leakage around the blade tip 58. A thermal barrier coating 73 can also be applied to at least a portion of the radially inner face 54 and/or the seal 70 to protect the underlying substrate of the BOAS 50 from thermal fatigue and to enable higher operating conditions. Any suitable thermal bather coating 73 could be applied to any portion of the BOAS 50.

In one exemplary embodiment, the leading edge portion 62 of the BOAS 50 includes a seal land 74 and a retention flange 76. The seal land 74 and the retention flange 76 can extend from the seal body 52. In this embodiment, the seal land 74 is formed integrally with the seal body 52 as a monolithic piece and the retention flange 76 can be attached to the seal body 52, such as by brazing or welding. Alternatively, the retention flange 76 could also be formed integrally with the seal body 52 as a monolithic piece. As discussed in greater detail below with respect to FIG. 3, the seal land 74 seals (relative to a vane 27) the gas turbine engine 20 and also radially supports the retention flange 76. The retention flange 76 secures the BOAS 50 relative to the engine static structure 33 to retain the vane 25 in the radial direction.

The trailing edge portion 64 of the BOAS 50 may also include an engagement feature 88 for attaching the trailing edge portion 64 of the BOAS 50 to the engine static structure 33. The engagement feature 88 could include a hook, a flange or any other suitable structure for supporting the BOAS 50 relative to the engine static structure 33.

The seal land 74 includes an inward pointing extension 78. The inward pointing extension 78 may axially and radially extend to a position that is radially inward relative to the radially inner face 54 of the seal body 52. The seal land 74 also includes one or more support portions 80 that radially support the retention flange 76. In this exemplary embodiment, the seal land 74 includes a first support portion 80A and a second support portion 80B that axially extend parallel to the engine longitudinal centerline axis A (See FIG. 3). The first support portion 80A and the second support portion 80B are transverse to the inward pointing extension 78. In the illustrated embodiment, the first support portion 80A and the second support portion 80B are perpendicular to the inward pointing extension 78.

The retention flange 76 may include a radially inner portion 82 and a radially outer portion 84. The radially outer portion 84 is engaged relative to the engine static structure 33 and the radially inner portion is engaged relative to a vane 27 (See FIG. 3). In this exemplary embodiment, the radially inner portion 82 is generally L-shaped and the radially outer portion 84 is generally U-shaped.

Figure 3:
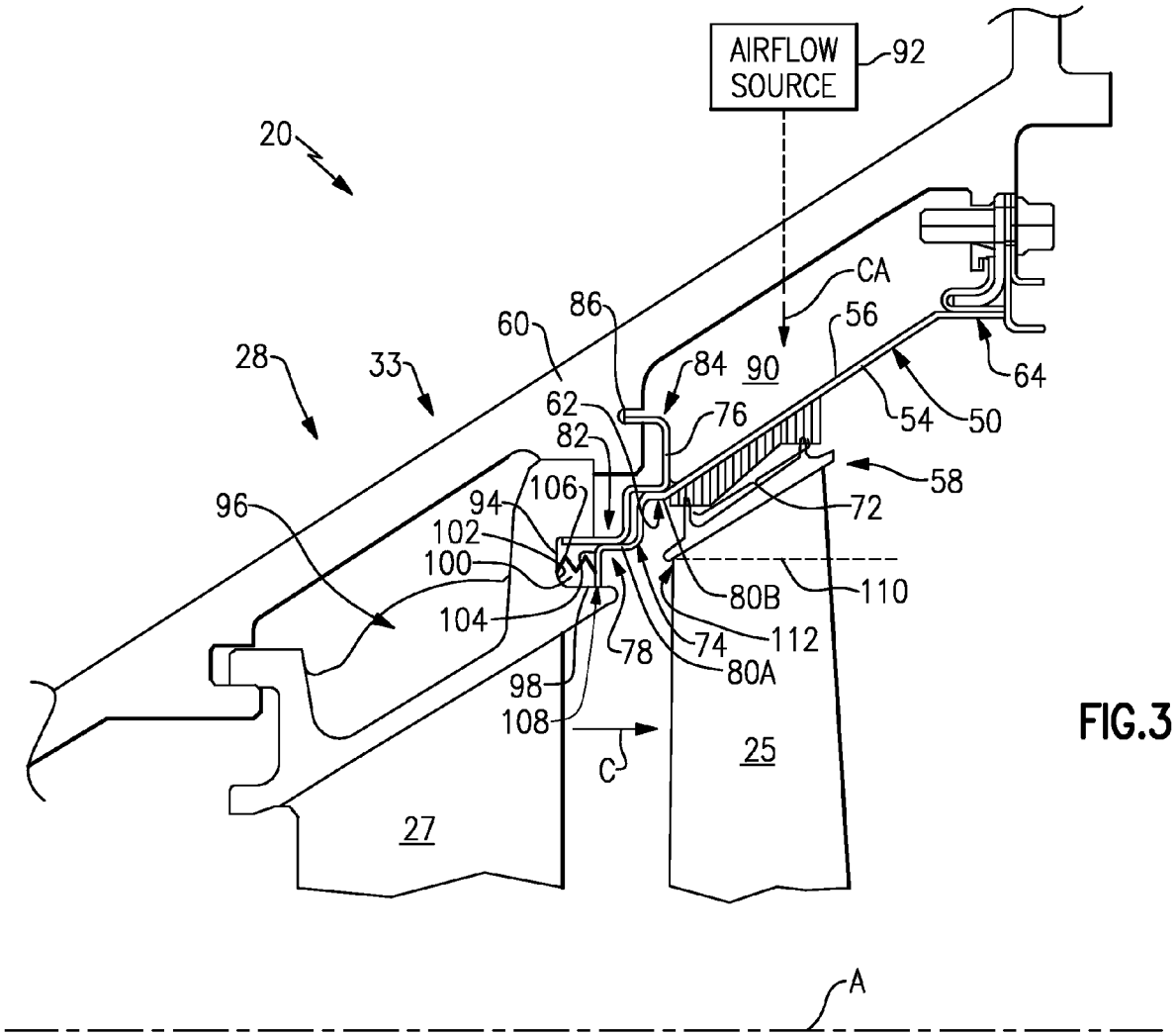
FIG. 3 illustrates a cross-sectional view of a portion of a gas turbine engine that can incorporate a BOAS.

FIG. 3 illustrates a cross-sectional view of the BOAS 50 mounted within the gas turbine engine 20. The BOAS 50 is mounted radially inward from a casing 60 of the engine static structure 33. The casing 60 may be an outer engine casing of the gas turbine engine 20. In this exemplary embodiment, the BOAS 50 is mounted within the turbine section 28 of the gas turbine engine 20. However, it should be understood that other portions of the gas turbine engine 20 could benefit from the teachings of this disclosure, including but not limited to, the compressor section 24.

In this exemplary embodiment, a blade 25 (only one shown, although multiple blades could be circumferentially disposed about a rotor disk (not shown) within the gas turbine engine 20) is mounted for rotation relative to the casing 60 of the engine static structure 33. In the turbine section 28, the blade 25 rotates to extract energy from the hot combustion gases that are communicated through the gas turbine engine 20 along the core flow path C. A vane 27 is also supported within the casing 60 adjacent to the blade 25. The vane 27 (additional vanes could circumferentially disposed about the engine longitudinal centerline axis A as part of a vane assembly) prepares the core airflow for the blade(s) 25. Additional rows of vanes could also be disposed downstream from the blade 25.

The blade 25 includes a blade tip 58 at a radially outermost portion of the blade 25. In this exemplary embodiment, the blade tip 58 includes a knife edge 72 that extends toward the BOAS 50. The BOAS 50 establishes an outer radial flow path boundary of the core flow path C. The knife edge 72 and the BOAS 50 cooperate to limit airflow leakage around the blade tip 58. The radially inner face 54 of the BOAS faces toward the blade tip 58 of the blade 25 (i.e., the radially inner face 54 is positioned on the core flow path C side) and the radially outer face 56 faces the casing 60 (i.e., the radially outer face 56 is positioned on a non-core flow path side).

The BOAS 50 is disposed in an annulus radially between the casing 60 and the blade tip 58. Although this particular embodiment is illustrated in cross-section, the BOAS 50 may be attached at its mate faces 66, 68 (See FIG. 2) to additional blade outer air seals to circumscribe associated blades 25 of the compressor section 24 or the turbine section 28. A cavity 90 radially extends between the casing 60 and the radially outer face 56 of the BOAS 50. The cavity 90 can receive a dedicated cooling airflow CA from an airflow source 92, such as bleed airflow from the compressor section 24, that can be used to cool the BOAS 50.

The radially outer portion 84 of the retention flange 76 is received within a slot 86 of the casing 60 to radially retain the BOAS 50 to the casing 60 at the leading edge portion 62. The radially inner portion 82 can be received within a groove 94 of a vane segment 96 of the vane 27 to radially support the vane 27. In this exemplary embodiment, the vane segment 96 is a vane platform and the groove 94 is positioned on the aft, radially outer diameter side of the vane 27. The vane segment 96 rests against the radially inner portion 82.

The seal land 74 radially supports the retention flange 76 at the first support portion 80A and the second support portion 80B of the inward pointing extension 78. In other words, the retention flange 76 contacts the inward pointing extension 78 of the seal land 74 such that the vane 27 is prevented from creeping inboard a distance that would otherwise permit the vane segment 96 from being liberated from the casing 60.

The inward pointing extension 78 extends radially inwardly from the radially inner face 54 and contacts a portion 98 of the vane segment 96 such that a pocket 100 extends between an aft wall 102 of the vane segment 96 and an upstream wall 104 of the inward pointing extension 78. A seal 106 can be received within the pocket 100 between the aft wall 102 and the upstream wall 104. The radially inner portion 82 of the retention flange 76 extends radially outwardly from the seal 106.

In this exemplary embodiment, the seal 106 is a W-seal. However, other seals are also contemplated as within the scope of this disclosure, including but not limited to, sheet metal seals, C-seals, and wire rope seals. The seal 106 prevents airflow from leaking out of the cavity 90 into the core flow path C (and vice versa). The inward pointing extension 78 also acts as a heat shield by blocking hot combustion gases that may otherwise escape the core flow path C and radiate into the vane segment 96 or other portions of the vane 27.

The inward pointing extension 78 of the seal land 74 further includes a radially innermost surface 108 that extends inboard from the blade tip 58 of the blade 25. In this exemplary embodiment, the radially innermost surface 108 extends inboard from a longitudinal axis 110 that extends through a leading edge 112 of the blade tip 58.

Although the different non-limiting embodiments are illustrated as having specific components, the embodiments of this disclosure are not limited to those particular combinations. It is possible to use some of the components or features from any of the non-limiting embodiments in combination with features or components from any of the other non-limiting embodiments.

It should be understood that like reference numerals identify corresponding or similar elements throughout the several drawings. It should also be understood that although a particular component arrangement is disclosed and illustrated in these exemplary embodiments, other arrangements could also benefit from the teachings of this disclosure.

The foregoing description shall be interpreted as illustrative and not in any limiting sense. A worker of ordinary skill in the art would recognize that various modifications could come within the scope of this disclosure. For these reasons, the following claims should be studied to determine the true scope and content of this disclosure.

What is claimed is:

1. A blade outer air seal (BOAS) for a gas turbine engine, comprising:

a seal body having a radially inner face and a radially outer face that axially extend between a leading edge portion and a trailing edge portion;

a seal land that extends in a first direction relative to said seal body and includes an inward pointing extension that contacts a portion of a vane segment, said seal land and said inward pointing extension is a monolithic structure; and a retention flange that extends in a second direction relative to said seal body, and said retention flange is a separate and distinct component from said seal land.

2. The BOAS as recited in claim 1, wherein said retention flange includes a radially outer portion and a radially inner portion, and said radially outer portion is received within a slot of a casing of the gas turbine engine and a vane segment rests against said radially inner portion.

3. The BOAS as recited in claim 1, wherein said retention flange is positioned radially outwardly of said seal land.

4. The BOAS as recited in claim 1, wherein said retention flange contacts at least one support portion of said seal land.

5. The BOAS as recited in claim 4, wherein said at least one support portion is an axially extending portion of said seal land.

6. The BOAS as recited in claim 1, comprising a seal attached to said radially inner face of said seal body.

7. The BOAS as recited in claim 6, wherein said seal is a honeycomb seal.

8. The BOAS as recited in claim 1, comprising a seal that extends between said inward pointing extension and a vane segment.

9. The BOAS as recited in claim 1, wherein a radially innermost surface of said inward pointing extension extends to a position inboard of a blade tip of a blade that rotates relative to said seal body.

10. The BOAS as recited in claim 1, comprising a seal received within a pocket established between an aft wall of said vane segment and an upstream wall of said inward pointing extension.

11. The BOAS as recited in claim 1, wherein a radially innermost surface of said inward pointing extension contacts said vane segment.

12. A gas turbine engine, comprising:

a compressor section;

a combustor section in fluid communication with said compressor section;

a turbine section in fluid communication with said combustor section;

a blade outer air seal (BOAS) associated with at least one of said compressor section and said turbine section, wherein said BOAS includes:

a seal body having a radially inner face and a radially outer face that axially extend between a leading edge portion and a trailing edge portion;

a seal land that extends from said seal body and includes an inward pointing extension that is integral with said seal land such that said seal land and said inward pointing extension is a monolithic structure; and a retention flange that retains said BOAS relative to a casing of the gas turbine engine, said retention flange supported by said seal land at least at two different radial locations of said retention flange, said seal land in physical contact with a radially inner surface of said retention flange at said at least two different radial locations.

13. The gas turbine engine as recited in claim 12, wherein a radially innermost surface of said inward pointing extension extends to a position inboard of a blade tip of a blade of one of said compressor section and said turbine section.

14. The gas turbine engine as recited in claim 12, wherein said retention flange includes a radially outer portion and a radially inner portion, and said radially outer portion is received within a slot of said casing and a vane segment of one of said compressor section and said turbine section rests against said radially inner portion.

15. The gas turbine engine as recited in claim 12, comprising a seal that extends within a pocket between said inward pointing extension and a vane segment.

16. The gas turbine engine as recited in claim 15, wherein at least a portion of said retention flange extends radially outwardly from said seal.

17. A method of incorporating a blade outer air seal (BOAS) for use in a gas turbine engine, comprising:

positioning a seal axially between a vane segment of the gas turbine engine and an inward pointing extension of a seal land of the BOAS such that the seal abuts both the vane segment and the inward pointing extension; and supporting a retention flange of the BOAS with the seal land to radially support the vane segment, the retention flange supported at two different radial locations of the retention flange such that the seal land is in physical contact with a radially inner surface of the retention flange at the two different radial locations.

18. The method as recited in claim 17, comprising:

blocking hot combustion gases from escaping a core flow path of the gas turbine engine with the seal land.

19. The method as recited in claim 18, wherein the step of blocking includes shielding the vane segment with the inward pointing extension of the seal land.

20. The method as recited in claim 17, wherein the step of supporting includes positioning at least one support portion of the seal land radially inwardly from the retention flange.

21. The method as recited in claim 17, wherein a radially outer portion of the retention flange is received within a slot of a casing that surrounds the BOAS and the vane segment rests against a radially inner portion of the retention flange.

22. The method as recited in claim 17, wherein the seal abuts against an upstream wall of the inward pointing extension.

* * * * *